US011339540B1

(12) United States Patent
Cobb et al.

(10) Patent No.: US 11,339,540 B1
(45) Date of Patent: May 24, 2022

(54) METHOD AND SYSTEM FOR EVALUATING AND REPAIRING A SURFACE AND/OR SUBSURFACE

(71) Applicant: Roof Asset Management USA, Ltd., Brunswick, OH (US)

(72) Inventors: Joseph C. Cobb, Medina, OH (US); Jeffrey L. Cacioppo, Medina, OH (US)

(73) Assignee: Roof Asset Management USA, Ltd., Brunswick, OH (US)

( * ) Notice: Subject to any disclaimer, the term of this patent is extended or adjusted under 35 U.S.C. 154(b) by 0 days.

(21) Appl. No.: 16/774,067

(22) Filed: Jan. 28, 2020

Related U.S. Application Data

(60) Provisional application No. 62/797,761, filed on Jan. 28, 2019.

(51) Int. Cl.

| | |
|---|---|
| ***E01C 11/00*** | (2006.01) |
| ***E01C 19/45*** | (2006.01) |
| ***E01C 23/01*** | (2006.01) |
| ***E01C 19/17*** | (2006.01) |

(52) U.S. Cl.
CPC ..... *E01C 11/005* (2013.01); *E01C 19/176* (2013.01); *E01C 19/45* (2013.01); *E01C 23/01* (2013.01)

(58) Field of Classification Search
CPC ..... E01C 11/005; E01C 19/176; E01C 19/45; E01C 23/01
USPC ..... 404/84.05, 101–111, 75
See application file for complete search history.

(56) References Cited

U.S. PATENT DOCUMENTS

| | | | | |
|---|---|---|---|---|
| 5,447,388 | A * | 9/1995 | Rouse | B01F 3/1221 404/101 |
| 5,584,597 | A * | 12/1996 | Lemelson | E01C 23/06 299/41.1 |
| 5,895,173 | A * | 4/1999 | O'Brien | E01C 19/21 404/108 |
| 5,947,636 | A * | 9/1999 | Mara | E01C 23/07 404/84.05 |
| 7,104,724 | B2 * | 9/2006 | Terry | E01C 7/185 404/101 |
| 9,233,644 | B2 * | 1/2016 | Shimomura | B60R 1/00 |
| 9,303,368 | B2 | 4/2016 | Reda | |
| 9,903,078 | B2 | 2/2018 | Ali | |
| 9,988,772 | B2 | 6/2018 | Flitsch et al. | |
| 10,087,589 | B2 | 10/2018 | Yun et al. | |
| 10,465,345 | B2 * | 11/2019 | Exline | E01C 19/176 |
| 2011/0182664 | A1 * | 7/2011 | Brodie | E01C 23/098 404/107 |
| 2016/0138228 | A1 * | 5/2016 | Rainwater | E01C 19/176 404/111 |
| 2018/0148898 | A1 * | 5/2018 | Shimada | G01B 21/30 |
| 2020/0116484 | A1 * | 4/2020 | Agouridis | G01C 7/04 |

* cited by examiner

*Primary Examiner* — Raymond W Addie
(74) *Attorney, Agent, or Firm* — Edwin A. Sisson, Attorney at Law, LLC; Jeffrey J. Banyas

(57) ABSTRACT

A method and a system for evaluating a surface and/or subsurface for a plurality of conditions may comprise a surface contaminant removal device, an illuminating device, a detector unit, and a vehicle capable of travelling at a velocity of at least 1 mph. The method and system may include repair of at least one condition of the plurality of conditions. The repair system may include one or more vessels in fluid communication with a nozzle array.

10 Claims, 5 Drawing Sheets

METHOD AND SYSTEM FOR EVALUATING AND REPAIRING A SURFACE AND/OR SUBSURFACE

CROSS REFERENCES AND PRIORITIES

This application claims priority from United States Provisional Application No. 62/797,761 filed on 28 Jan. 2019 the teachings of which are incorporated by reference herein in their entirety.

BACKGROUND

Repair and maintenance of surfaces is important in many different fields, particularly those involving infrastructure such as roads, walls and bridges. Over time, these surfaces may decay leading to cracks, holes, and other defects. If not repaired or maintained, the surface may become so decayed as to be unusable, requiring expensive replacements.

The simplest methods for repairing and maintaining surfaces involve a great deal of manual labor. For instance, where the surface is a road, a person may be deployed with a bucket of repair materials such as hot tar, sealant, or asphalt. The person then identifies cracks, holes, and other defects in the road surface, and deposits the repair materials into or onto the defect. In addition to being labor intensive, this process also results in significant waste as the person is often incapable of precession depositing the repair materials only onto or into the particular defect. This process also presents significant health risks to the person who is tasked with carrying a heavy bucket of repair material from one location to the next. In addition, the process is also time intensive, often causing a lengthy period of non-use of the surface. This can be particularly problematic in road repair situations where the road—or at least a portion of the road—may need to be closed for a length of time while the person makes the repair.

Many attempts have been made to develop a more efficient and safer method to repair a surface. One example is disclosed in U.S. Pat. No. 9,303,368 B2 (the "368 Patent"). The '368 Patent discloses "[a]n apparatus including a multidirectional positioning system and a scanner. The scanner scans the volume of a three-dimensional cavity, and the scanner is attached to the multi-directional positioning system. A processor receives volume data of the cavity and stores the volume data in a data storage memory. A material depositing mechanism is attached to the multidirectional positioning system, and the material depositing mechanism is controlled to move with respect to a shape of the cavity based on the volume data stored in the process so as to fill in the cavity with a filler material."

The apparatus disclosed in the '368 Patent repairs surfaces at a very low speed, requiring lengthy periods of non-use of the surface being repaired. Additionally, the '368 Patent makes several passes over the surface defect, further increasing the length of non-use periods.

Another attempt is disclosed in U.S. Pat. No. 10,087,589 B2 (the "589 Patent"). The '589 Patent discloses "[a] vehicle system for automatic repairing of road potholes includes: a laser camera that measures distance from a vehicle to the pothole and calculates surface area based on the image and distance information, a first support shaft that moves back and forth, a multi operation device that cuts and crushes asphalt and flattens asphalt concrete, a heating device that melts asphalt, an asphalt vacuum suction device that sucks in asphalt and stores fragments in a residue storage tank, an asphalt concrete storage tank that stores asphalt concrete and supplies asphalt concrete around the road pothole, a residue storage tank that stores crushed asphalt sucked in, an oil supply nozzle that supplies oil, an air supply pump that supplies strong air for cleaning, and a vehicle device that operates power switch, cutting device motor, asphalt vacuum suction device, air supply pump, asphalt concrete volume calculation part, and roller part."

The vehicle system disclosed in the '589 Patent is only useful on potholes, and even then requires the use of the existing surface material (the cut and crushed asphalt) in recycled/re-used form. Processing this recycled/re-used surface material within the vehicle can slow down the process resulting in lengthy periods of non-use.

The need exists, therefore, for an improved process for evaluating and repairing a surface with improved precision, reduced waste, and improved repair time.

SUMMARY

A method of evaluating a surface and/or subsurface for a plurality of conditions is disclosed. The method may comprise the steps of a) removing a plurality of surface contaminants from the surface, b) illuminating the surface, c) sending a signal to the surface wherein said signal may contact the surface and at least a first portion of said signal may be returned to a first receiving unit, d) receiving the first portion of the signal at the receiving unit, e) plotting the surface using the first portion of the signal to obtain a surface map, and f) analyzing the surface map to identify at least one condition of the plurality of conditions. The method may be conducted by passing a vehicle over the surface. In some embodiments, the vehicle may pass over the surface at a velocity of at least 1 mph.

The method may comprise the further steps of e) identifying a first condition from the surface map wherein said first condition may have a plurality of X coordinates, a plurality of Y coordinates, and a plurality of Z coordinates, f) communicating the plurality of X coordinates, the plurality of Y coordinates, and the plurality of Z coordinates to a dispensing unit comprising a repair material, and g) dispensing the repair material through a first nozzle array to the first condition. In some embodiments, steps e, f, and g may be repeated for a plurality of subsequent conditions.

In some embodiments, the method may further comprise the step of applying a hardening agent through a second nozzle array to the repair material. In some embodiments, the hardening agent may further comprise a filler material.

In some embodiments, the method may further comprise the step of applying a coating through a second nozzle array to a top surface of the repair material. Applying the coating may be conducted with or without applying a hardening agent. When the coating is conducted without applying a hardening agent, the coating may be applied through a third nozzle array.

The repair material may be selected from the group consisting of asphalt, tar, concrete, soil, sand, gravel, and epoxy.

The step of illuminating the surface may be conducted using one or more light sources selected from the group consisting of an infrared light source, an LED light source, a quartz light source, a halogen light source, a fluorescent light source, a xenon light source, and combinations thereof.

The signal may be selected from the group of signals consisting of ground penetrating radar (GPR), lidar, ultrasound, and combinations thereof.

A system for evaluating a surface and/or subsurface for a plurality of conditions is also disclosed. The system may comprise a surface contaminant removal device, an illumination device, a detector unit comprising at least one device selected from the group consisting of ground penetrating radar (GPR), lidar, ultrasound, and combinations thereof, and a vehicle capable of travelling at a velocity of at least 1 mph.

In some embodiments, the system may further comprise a first dispenser unit which may comprise a repair material vessel in fluid communication with a first nozzle array. The repair material vessel may comprise a first mixing unit. The first nozzle array may be movably arranged in the system.

In some embodiments, the system may further comprise a second dispenser unit which may comprise a hardening agent vessel in fluid communication with a second nozzle array. The hardening agent vessel may further comprise a second mixing unit. The second nozzle array may be movably arranged in the system.

In some embodiments, the system may further comprise a third dispenser unit comprising a coating vessel in fluid communication with a third nozzle array. The coating vessel may further comprise a third mixing unit. The third nozzle array may be movably arranged in the system.

DETAILED DESCRIPTION

Figure 1:
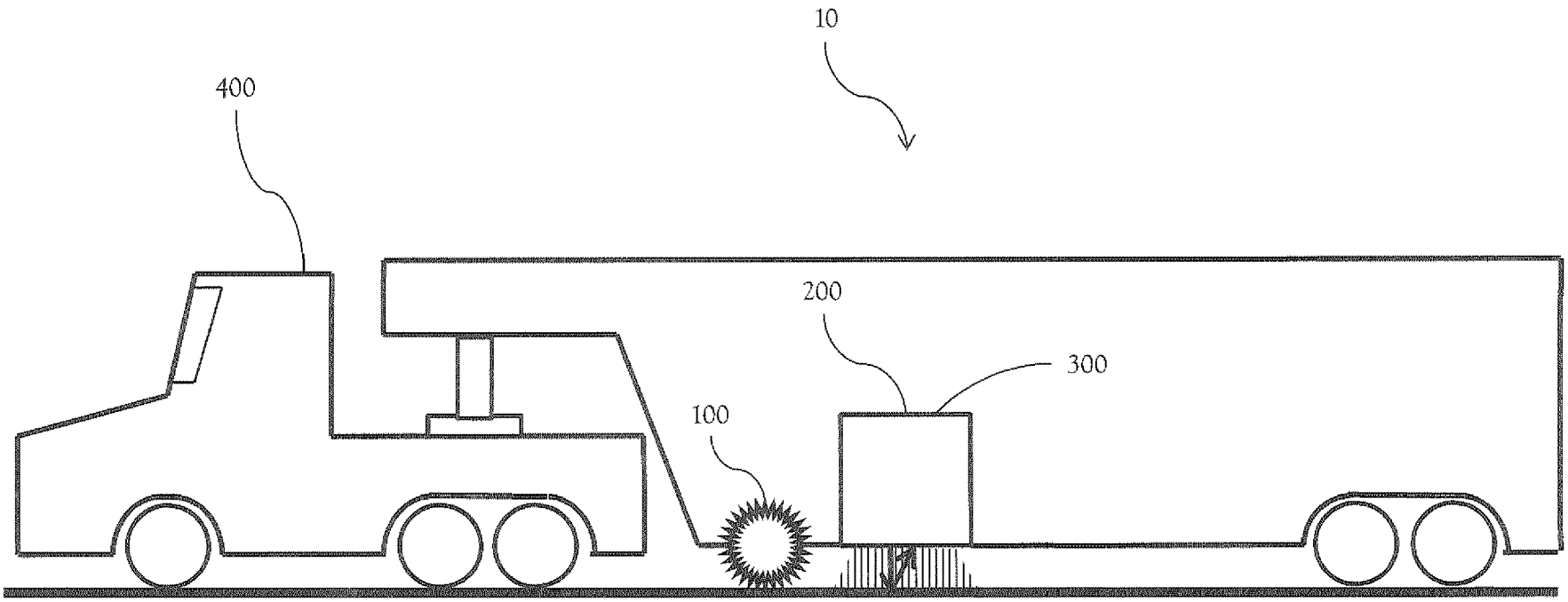
FIG. 1 depicts a side view of one embodiment of a system for evaluating a surface.

Disclosed herein is a method of evaluating a surface and/or subsurface for a plurality of conditions. Also disclosed herein is a system for evaluating a surface for a plurality of conditions. The method and system are described below with reference to the Figures. As described herein and in the claims, the following numbers refer to the following structures as noted in the Figures.

1 refers to a first row of nozzles.
1A refers to a first nozzle in the first row of nozzles.
2 refers to a second row of nozzles.
2A refers to a first nozzle in the second row of nozzles.
3 refers to a third row of nozzles.
4 refers to a fourth row of nozzles.
5 refers to a nozzle center point.
10 refers to a system for evaluating a surface.
100 refers to a surface contaminant removal device.
200 refers to an illumination device.
300 refers to a detector unit.
310 refers to a device.
400 refers to a vehicle.
500 refers to a first dispenser unit.
600 refers to a second dispenser unit.
700 refers to a third dispenser unit.

The method of evaluating a surface for a plurality of conditions may begin by removing a plurality of surface contaminants from the surface. The surface may be a paved surface or an un-paved surface. Examples of paved surfaces may include—but is not limited to—roads, highways, parking lots, drive ways, sidewalks, airport runways, and tennis courts. Examples of un-paved surfaces may include—but is not limited to—include lawns, sports fields, frozen bodies of water, fields, walls, bridge supports, and ski slopes. Removal of surface contaminants from the surface is considered a surface preparation step in which the surface is prepared for later evaluation and repair steps. The types of surface contaminants include—but are not limited to—dirt, sand, gravel, grease, oil, water, grass clippings, paper garbage, metal garbage, and glass garbage.

After removing the plurality of surface contaminants from the surface, the next step in the method may be illuminating the surface. Illuminating the surface may improve the ability of one or more sensors to detect a surface condition. Illuminating the surface may include light field illumination, dark field illumination, or a combination of light and dark field illumination. In light field illumination, surface variations are displayed as a plurality of dark pixels against a bright background. In dark field illumination, surface variations are displayed as a plurality of bright pixels against a dark background.

Illuminating the surface may be conducted using one or more light sources selected from the group consisting of an infrared light source, an LED light source, a quartz light source, a halogen light source, a fluorescent light source, a xenon light source, and combinations thereof. When used, the infrared light source preferably emits energy in a range selected from the group consisting of between 0.5 and 2.0 microns, between 0.5 and 1.7 microns, between 0.5 and 1.5 microns, between 0.6 and 2.0 microns, between 0.6 and 1.7 microns, between 0.6 and 1.5 microns, between 0.7 and 2.0 microns, between 0.7 and 1.7 microns, and between 0.7 and 1.5 microns.

The type of light source and type of field illumination may be selected by first passing a plurality of sensors over the surface to detect the surface geometry, structure, color, and filtering. For instance, when the surface is a blacktop roadway, one would select fiber optic illuminator light source (comprising an LED light source with a fiber optic cabling) to position the lighting axially or parallel to the device sending the signal to the surface. The fiber optic illuminator light source operates in dark field illumination such that the surface variations are displayed as a plurality of bright pixels against a black background.

As an alternative example, when the surface is a dirt, soil, grass or other surface having larger variation in surface patterning, one would select light field illumination sources. Lighting sources for light field illumination may include halogen light sources, xenon light source, or other light sources having a high color temperature.

Simultaneous with illuminating the surface, the method may include sending a signal to the surface. The signal may contact the surface, and at least a first portion of the signal may be returned to a first receiving unit. In doing so, the method may include the step of receiving the first portion of the signal at the receiving unit.

The signal may be selected from the group consisting of ground penetrating radar (GPR), lidar, ultrasound, and combinations thereof. When used, the ground penetrating radar sends out radar pulses in the form of electromagnetic radiation in the microwave band of the radio spectrum, and detects reflected signals returning from the subsurface structure. When used, the lidar sends out a pulsed laser light, and detects reflected pulses with a sensor. When used, ultrasound sends out sound waves having a frequency greater than 20,000 Hz and detects reflected sound waves returning from the surface. In this regard it is noted that, when the signal includes ground penetrating radar, the receiving unit will include a ground penetrating radar receiver. Similarly, when the signal includes lidar, the receiving unit will include a lidar receiver. Finally, when the signal includes ultrasound, the receiving until will include an ultrasound receiver.

The method may then comprise the step of plotting the surface using the first portion of the signal to obtain a surface map. The surface map will include the surface, and the plurality of surface conditions. In this regard, the method may include the step of analyzing the surface map to identify at least one condition of the plurality of surface conditions. Common surface conditions may include longitudinal cracks, alligatoring, fan cracks, surface deformations, subsurface delamination, and holes.

Preferably, the method is conducted by passing a vehicle over the surface. The vehicle may be selected from the group consisting of a car, a truck, a van, or a tractor. The vehicle may pass over the surface at a velocity of at least 1 mph, with a velocity of at least 5 mph being more preferred, a velocity of at least 10 mph being even more preferred, a velocity of at least 25 mph being still more preferred, and a velocity of at least 50 mph being most preferred. In some embodiments, the vehicle may pass over the surface at a velocity not exceeding 70 mph. Accordingly, the vehicle may be said to pass over the surface at a velocity in a range selected from the group consisting of between 1 mph and 70 mph, between 5 mph and 70 mph, between 10 mph and 70 mph, between 25 mph and 70 mph, and between 50 mph and 70 mph.

While the method may be used to evaluate the surface and/or subsurface for a plurality of conditions, any number of which may call for repairs to the surface, in some instances it may be desired to repair one or more of the conditions in conjunction with evaluating the surface. Accordingly, the method may include further steps directed to repairing one or more of a plurality of conditions on or in a surface.

For instance, the method may include identifying a first condition from the surface map. The first condition may have a plurality of X coordinates and a plurality of Y coordinates defining the easting (corresponding to the X coordinate) and northing (corresponding to the Y coordinate) direction of the first condition. The first condition may also have a plurality of Z coordinates with each Z coordinate being in a plane perpendicular to one of the X and Y coordinates such that each Z coordinate defines a depth of the first condition at a particular X and Y coordinate. The plurality of X coordinates, plurality of Y coordinates, and plurality of Z coordinates thus define a first condition area. The first condition may be selected from the group consisting of a longitudinal crack, an alligator condition, a fan crack, a surface deformation, a subsurface delamination, and a hole.

Once the first condition is identified, the method may include communicating the plurality of X coordinates, the plurality of Y coordinates, and the plurality of Z coordinates corresponding to the first condition to a dispensing unit. The dispensing unit preferably comprises a repair material. The method may then comprise the step of dispensing the repair material through a first nozzle to the first condition. By "to the first condition" it is meant that repair material is dispensed into the first condition area defined by the plurality of X coordinates, the plurality of Y coordinates, and the plurality of Z coordinates. The type of repair material will be a function—at least in part—of the type of surface and the type(s) of condition(s), and may include a variety of materials designed to effectively repair the specific condition(s) for the type of surface. The type of repair material may be selected from the group consisting of asphalt, tar, concrete, soil, sand, gravel, and epoxy.

In some embodiments, it may be desirable to apply one or more additional treatments to the repair material after dispensing the repair material to the first condition. For instances, in some embodiments, it may be desirable to apply a hardening agent through a second nozzle to the repair material. The hardening agent may be an acrylic polymer resin in a solvent carrier. When used, the hardening agent may decrease the time required for the repair material to harden or "set", thereby allowing the surface to return to a useable state in a shorter period of time. In some embodiments, the hardening agent may include a filler material such as a fiber (glass or carbon) matrix which can improve the durability of the repair material.

In other embodiments, it may be desirable to dispense a coating through a second nozzle to a top surface of the repair material. The type of coating will be a function—at least in part—of the type of surface, the type(s) of condition(s) being repaired, the type of repair material used, and the presence and type of hardening agent. Depending upon the application the coating may be selected from the group consisting of a wax sealant, a silicone sealant, bitumen, a mineral cover coating, an organic cover coating, and a fiber matrix material. The coating may be applied instead of or in addition to the hardening agent. When used, the coating may protect the repair material from future deformation, degradation, or abrasion.

It should be noted that, when the method includes repairing one or more of the plurality of conditions, the method is preferably conducted by passing a vehicle over the surface. The vehicle may be selected from the group consisting of a car, a truck, a van, or a tractor. The vehicle may pass over the surface at a velocity of at least 1 mph, with a velocity of at least 5 mph being more preferred, a velocity of at least 10 mph being even more preferred, a velocity of at least 25 mph being still more preferred, and a velocity of at least 50 mph being most preferred. In some embodiments, the vehicle may pass over the surface at a velocity not exceeding 70 mph. Accordingly, the vehicle may be said to pass over the surface at a velocity in a range selected from the group consisting of between 1 mph and 70 mph, between 5 mph and 70 mph, between 10 mph and 70 mph, between 25 mph and 70 mph, and between 50 mph and 70 mph. Preferably the velocity of the vehicle is maintained at a consistent velocity throughout the evaluation and repairing phases. By consistent velocity it is meant that the vehicle velocity fluctuates by no more than plus or minus 2.0 mph over the course of the evaluation and repairing phases with no more than plus or minus 1.5 mph being preferred, no more than plus or minus 1.0 mph being more preferred, and no more than plus or minus 0.5 mph being most preferred. The vehicle is preferably the same vehicle used to conduct the evaluation steps of the method.

The various components (repair material, hardening agent, hardening agent with filler material, coating, etc.) may be applied by passing through an array of nozzles configured to cover at least a portion of the area to be repaired. The pattern of nozzles in the array, and the discharge trajectory of the individual nozzles within the array may be adjusted to compensate for variations in the material dispensed as well as variations in the longitudinal speed of the vehicle.

The nozzle array may be characterized in terms of the number of rows of nozzles within the array, the number of nozzles within each row, and the distance between the individual nozzles and the surface plane of the surface being repaired. The number of rows of nozzles may be an integer in a range selected from the group consisting of between 4 and 50, between 4 and 40, between 4 and 30, between 4 and 20, between 8 and 50, between 8 and 40, between 8 and 30, between 8 and 20, between 12 and 50, between 12 and 40, between 12 and 30, and between 12 and 20. The number of nozzles within each row may be an integer in a range selected from the group consisting of between 50 and 500, between 50 and 400, between 50 and 300, between 50 and 250, between 75 and 500, between 75 and 400, between 75 and 300, between 75 and 250, between 100 and 500, between 100 and 400, between 100 and 300, and between 100 and 250. The distance between the individual nozzles and the surface plane of the surface being repaired may be in a range selected from the group consisting of between 0.5 inches and 30 inches, between 0.5 inches and 20 inches, between 0.5 inches and 15 inches, between 0.5 inches and 10 inches, between 1 inch and 30 inches, between 1 inch and 20 inches, between 1 inch and 15 inches, between 1 inch and 10 inches, between 5 inches and 30 inches, between 5 inches and 20 inches, between 5 inches and 15 inches, and between 5 inches and 10 inches.

Figure 5:
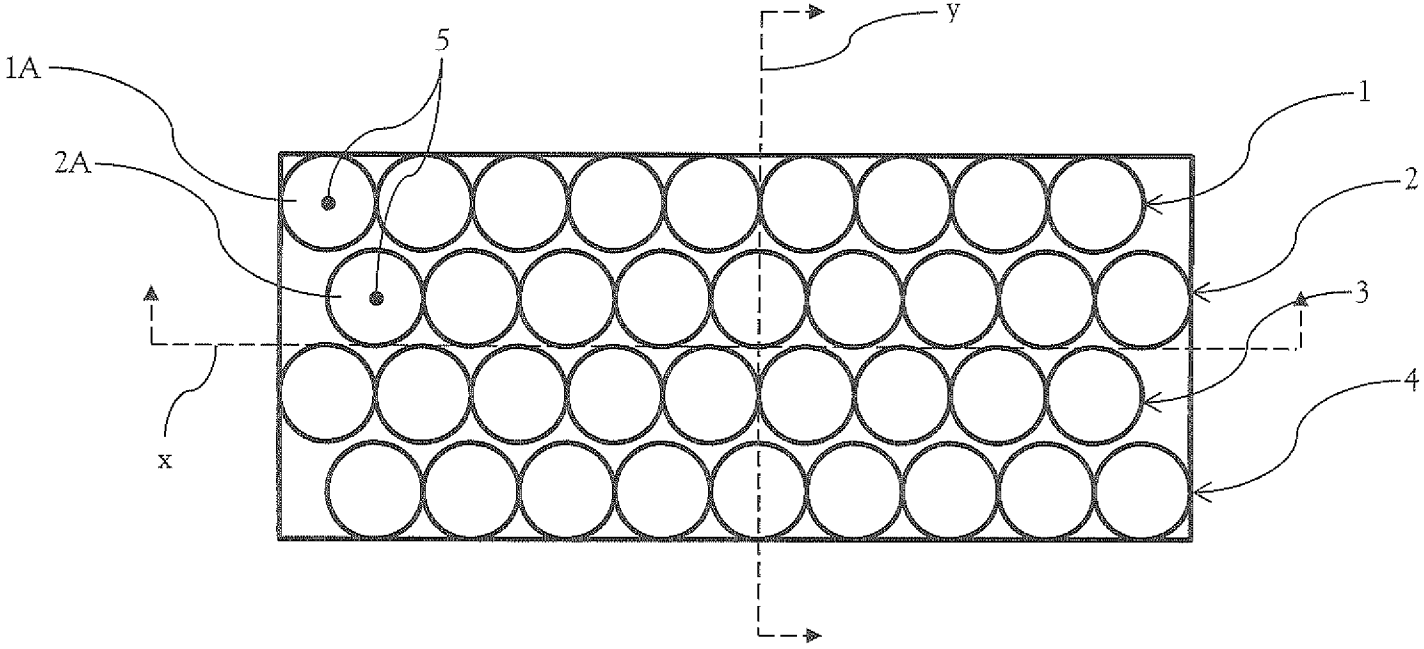
FIG. 5 depicts a top view of a nozzle array.

In some embodiments, each nozzle row may be offset along the x-axis relative to their preceding nozzle row in the y-axis as shown in FIG. 5. That is to say that each nozzle in the first row of nozzles (1) will have an x coordinate and a y coordinate corresponding to the center-point of the nozzle (5). Each nozzle in the second row of nozzles (2) will also have an x coordinate and a y coordinate corresponding to the center-point of the nozzle. The y coordinate of the individual nozzles in the second row will each be greater than the y coordinate of their corresponding nozzles in the first row. The same will be true for the individual nozzles in the third row, the fourth row, and so on. The difference in y coordinate value defines—at least in part—the different rows of nozzles.

The offset of each row of nozzles may be defined—at least in part—by the difference in x coordinate value between the individual nozzles that make up one row of nozzles and the individual nozzles that make up a subsequent row of nozzles. For instance, as shown in FIG. 5, a first nozzle in the first row of nozzles (1A) will have an x coordinate corresponding to the center-point of the nozzle (5). A first nozzle in the second row of nozzles (2A) will have an x coordinate corresponding to the center-point of the nozzle. When the rows of nozzles are offset, the x coordinate of the first nozzle in the second row of nozzles will have a value which is greater than the x coordinate of the first nozzle in the first row of nozzles. The amount by which the x coordinate value of the first nozzle in the second row of nozzles is greater than the x coordinate value of the first nozzle in the first row of nozzles will be repeated for the corresponding second nozzle, third nozzle, and so on within the first and second row of nozzles. This pattern may be reversed when comparing the second row of nozzles and the third row of nozzles (3). In other words, the x coordinate of the nozzles in the third row of nozzles may correspond to the x coordinate of the nozzles in the first row of nozzles. This pattern may be reversed again when comparing the third row of nozzles to the fourth row of nozzles (4). In other words, the x coordinate of the nozzles in the fourth row of nozzles may correspond to the x coordinate of the nozzles in the second row of nozzles. One of ordinary skill can easily envision how this pattern may repeat itself for each subsequent row of nozzles.

The amount by which the x coordinate and y coordinate varies with each individual row will vary based on a number of factors, including—but not limited to—the type of surface being repaired, the type of repair material being discharged, the discharge velocity, and the discharge trajectory. For example, the difference in y coordinate value between each row may be in a range selected from the group consisting of between 0.25 inches and 10 inches, between 0.25 inches and 5 inches, between 0.25 inches and 2 inches, between 0.5 inches and 10 inches, between 0.5 inches and 5 inches, between 0.5 inches and 2 inches, between 1 inch and 10 inches, between 1 inch and 5 inches, and between 1 inch and 2 inches. The difference in x coordinate value between one nozzle in an individual row (i.e. a first nozzle in the first row) and its corresponding nozzle in a subsequent row (i.e. a first nozzle in the second row) may be in a range selected from the group consisting of between 0 inches and 5 inches, between 0 inches and 2.5 inches, between 0 inches and 1 inch, between 0.25 inches and 5 inches, between 0.25 inches and 2.5 inches, between 0.25 inches and 1 inch, between 0.5 inches and 5 inches, between 0.5 inches and 2.5 inches, and between 0.5 inches and 1 inch. It should be noted that the difference in x coordinate (also known as offset) between corresponding nozzles in subsequent rows can vary from row to row. For example, the difference in x coordinate between an individual nozzle in the first row and the corresponding nozzle in the second row may be 0.25 inches while the difference in x coordinate between the corresponding nozzle in the second row and the corresponding nozzle in third row may be 0.75 inches.

For example, when the surface being repaired is a blacktop roadway, and the repair material is a bitumen based sealer the individual nozzles of the nozzle array may be configured at least five inches above the roadway surface plane. There may be twelve rows of nozzles comprising two-hundred eighty-eight nozzles in each row with a 0.25 inch offset along the x axis between each row of nozzles. Each row of nozzles may be spaced apart from one another along the y axis by 0.5 inches.

As another example, when the surface being repaired is a grass surface, such as a golf course fairway, and the repair material is sand, the individual nozzles of the nozzle array may be configured at least ten inches above the grass surface plane. There may be twelve rows of nozzles comprising one-hundred forty-four nozzles in each row with a 0.5 inch offset along the x axis between each row of nozzles. Each row of nozzles may be spaced apart from one another along the y axis by 0.5 inches.

The repair material will be ejected from the nozzle(s) at a discharge velocity and a discharge trajectory. The discharge velocity and discharge trajectory may be adjusted according to any number of variables—each of which is well known to one of ordinary skill in the art. Such variables may include—but are not limited to—the mass of the repair material, the viscosity of the repair material, the density of the repair material, the distance between the nozzle discharge and the surface being repaired, the size and shape of the nozzle's discharge orifice, and the angle of the nozzle relative to the surface being repaired.

The discharge velocity is preferably controlled to reduce the repair materials momentum at the time of impact with the surface being repaired. In addition to the variables cited above, the discharge velocity may also be influenced by the velocity at which the vehicle is travelling, and air flow at or around the nozzle discharge. A faster travelling vehicle and/or increased air flow at or around the nozzle may change the discharge velocity and/or discharge trajectory of the repair material, making it difficult to precisely apply the repair material in the desired location(s). These factors may be controlled in a number of ways including reducing the velocity of the vehicle, adding skirting around the nozzle(s)

extending to at or near the surface, adding airflow ducts around the area of the nozzles, and combinations thereof.

In some embodiments, the discharge velocity and/or discharge trajectory may be further controlled (in addition to the variables and factors cited above) by angling the nozzle (s) in the opposite direction to which the vehicle is travelling such that the "rearward" force of the discharged repair material partially or completely counteracts the "forward" momentum of the vehicle.

FIG. 1 depicts one embodiment of a system for evaluating a surface (10). As shown in FIG. 1, the system may include a surface contaminant removal device (100), an illumination device (200), and a detector unit (300), and a vehicle (400).

The surface contaminant removal device (100) may include one or more apparatus consisting of a brush, a fan, a blower, a high pressure water nozzle, and combinations thereof.

The illumination device (200) may improve the ability of one or more sensors to detect a surface condition. Illuminating the surface may be conducted using one or more light sources selected from the group consisting of an infrared light source, an LED light source, a quartz light source, a halogen light source, a fluorescent light source, a xenon light source, and combinations thereof. When used, the infrared light source preferably emits energy in a range selected from the group consisting of between 0.5 and 2.0 microns, between 0.5 and 1.7 microns, between 0.5 and 1.5 microns, between 0.6 and 2.0 microns, between 0.6 and 1.7 microns, between 0.5 and 1.5 microns, between 0.6 and 2.0 microns, between 0.6 and 1.7 microns, between 0.6 and 1.5 microns, between 0.7 and 2.0 microns, between 0.7 and 1.7 microns, and between 0.7 and 1.5 microns.

The detector unit (300) may include at least one device (310). The device is preferably capable of generating a signal in the direction of the surface, and receiving at least a portion of said signal reflected back from the surface. The device may be selected from the group consisting of ground penetrating radar (GPR), lidar, ultrasound, and combinations thereof. When used, the ground penetrating radar sends out radar pulses in the form of electromagnetic radiation in the microwave band of the radio spectrum, and detects reflected signals returning from the subsurface structure. When used, the lidar sends out a pulsed laser light, and detects reflected pulses with a sensor. When used, ultrasound sends out sound waves having a frequency greater than 20,000 Hz and detects reflected sound waves returning from the surface.

The vehicle (400) may include any number of vehicles. In some embodiments, there will be more than one vehicle with separate vehicles performing one or more separate functions (i.e. —surface contaminant removal, illumination and detection, repair material discharge, hardening agent discharge, coating discharge). Examples of such vehicles include a car, a truck, a van, or a tractor. Each of the surface contaminant removal device (100), the illumination device (200), and the detector unit (300) may independently be towed behind the vehicle as shown in FIG. 1, or pushed forward in front of the vehicle. One preferred vehicle is a semi-truck, which may tow an evaluation unit comprising the surface contaminant removal device, the illumination device, and the detector unit.

The vehicle should be capable of travelling at a velocity. Preferably, the velocity is at least 1 mph, with a velocity of at least 5 mph being more preferred, a velocity of at least 10 mph being even more preferred, a velocity of at least 25 mph being still more preferred, and a velocity of at least 50 mph being most preferred. In some embodiments, the vehicle may be capable of travelling at a velocity not exceeding 70 mph. Accordingly, the vehicle may be said to be capable of travelling at a velocity in a range selected from the group consisting of between 1 mph and 70 mph, between 5 mph and 70 mph, between 10 mph and 70 mph, between 25 mph and 70 mph, and between 50 mph and 70 mph.

Figure 2:
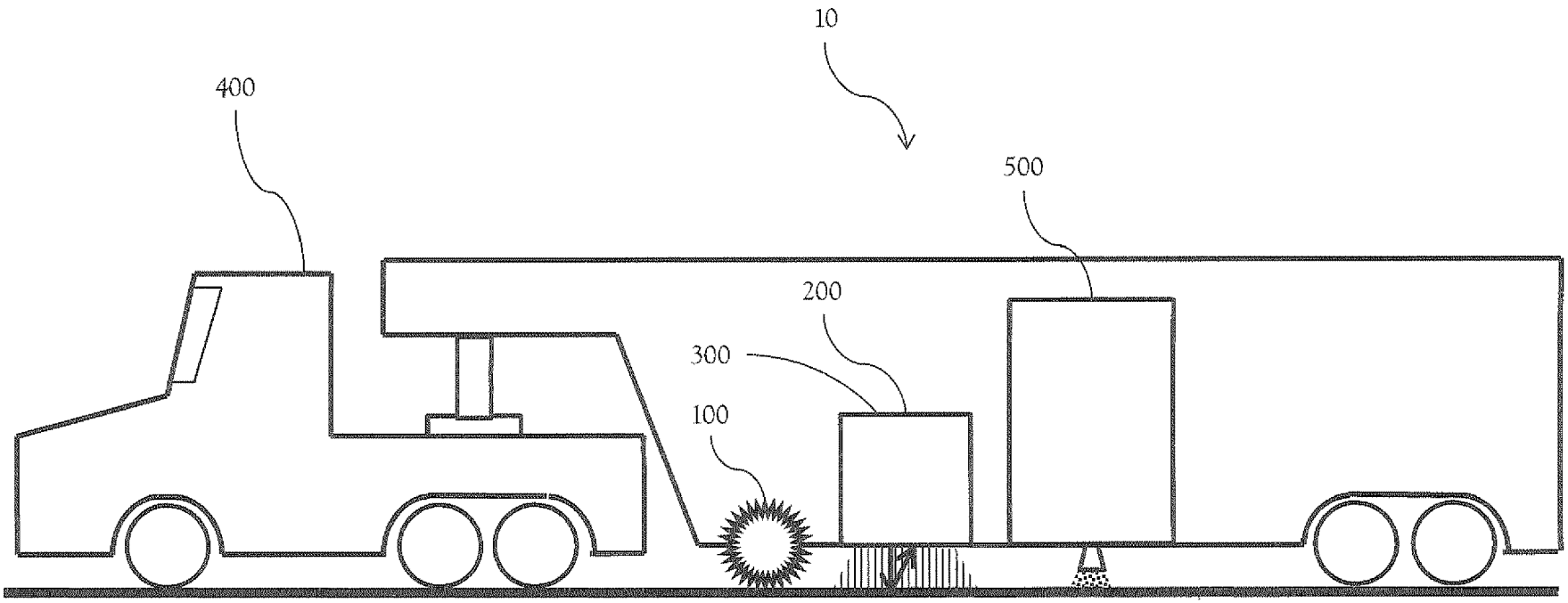
FIG. 2 depicts a side view of one embodiment of a system for evaluating and repairing a surface.
Figure 3:
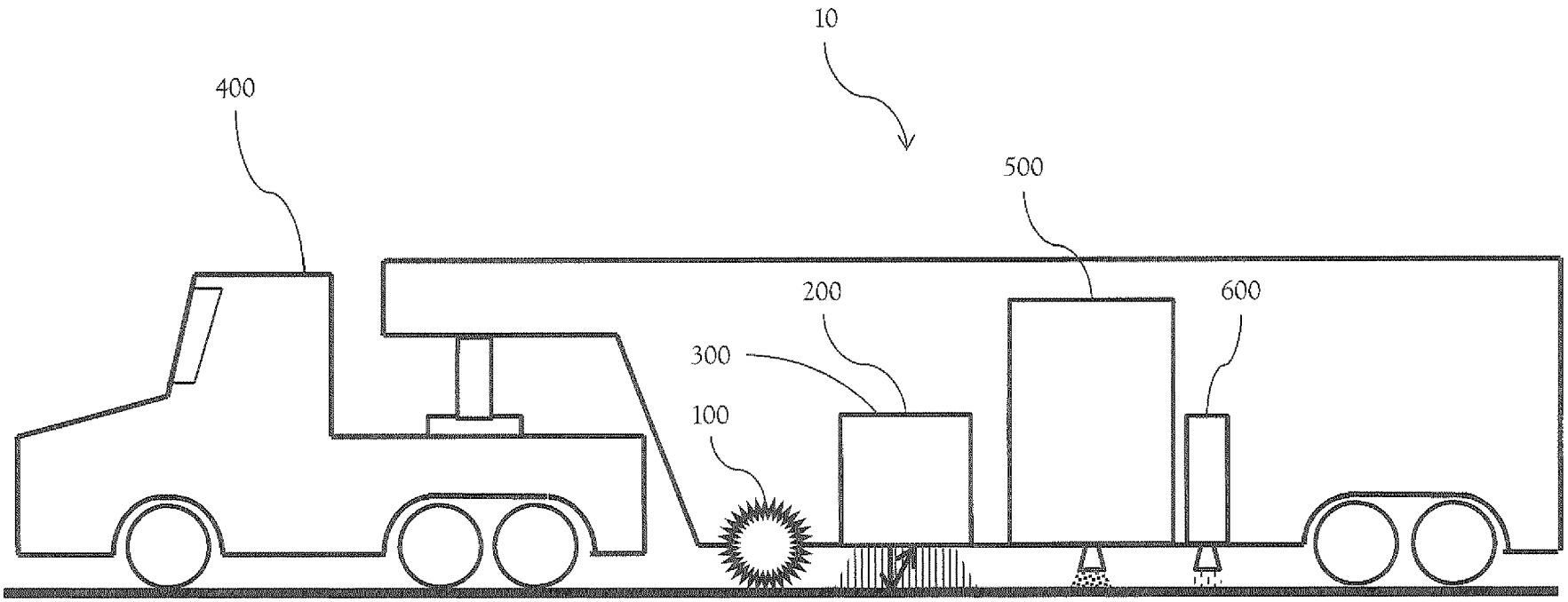
FIG. 3 depicts a side view of one embodiment of a system for evaluating and repairing a surface.

The vehicle may also include a sensor array comprising at least one sensor comprised of a global positioning system (GPS), a real time kinematic (RTK) positioning sensor, at least one continuously operating reference station (CORS) base station, and a vision positioning system (VPS). The vehicle may also be equipped with an inertial navigation system which will detect any roll, pitch, or yaw variations and communicate the same to one or more of the illumination device, the detector unit, the at least one device, the optional first dispenser unit ((500) as shown in FIG. 2) and the optional second dispenser unit ((600) as shown in FIG. 3). The vehicle may also be equipped with one or more of one or more motion dampening gyroscopes, one or more shock absorbers, one or more struts, one or more springs, and combinations thereof to reduce or eliminate roll, pitch, yaw, or vibrations, thereby improving the accuracy of the illumination device, the detector unit, the at least one device, the optional first dispenser unit and/or the optional second dispenser unit. The vehicle may also comprise at least one aerodynamic faring which may further assist in reducing or eliminating roll, pitch, yaw, or vibrations.

FIG. 2 shows an alternative embodiment of the system for evaluating a surface (10). As shown in FIG. 2, the system may comprise a first dispenser unit (500). The first dispenser unit may comprise a repair material vessel in fluid communication with a first nozzle array. The repair material vessel may contain the first repair material and, in some embodiments, may further comprise a first mixing unit for maintaining the various components of the repair material at a more consistent temperature, viscosity, and blend. The repair material may be selected from the group consisting of asphalt, tar, concrete, soil, sand, gravel, and epoxy. In some embodiments, the first dispenser unit may be partially or fully surrounded by skirting. In some embodiments, there may be one or more airflow ducts around the area of the first dispenser unit. Airflow duct(s) and skirting may be utilized individually or in combination with one another.

The first nozzle array may be movably arranged in the system. The first nozzle array may also be in electronic communication with the detector unit (300) such that the detector unit communicates to the first nozzle array the specific plurality of X coordinates, plurality of Y coordinates, and plurality of Z coordinates corresponding to one or more surface condition to be repaired. The detector unit may then signal at least one nozzle of the first nozzle array to move in the X and Y plane to the X coordinate position(s) and Y coordinate position(s) corresponding to the surface condition(s) to be repaired, and simultaneously signal at least one nozzle of the first nozzle array to change from a nozzle closed to a nozzle opened position for a period of time sufficient to dispense a volume of repair material from the nozzle sufficient to fill the volume of the surface condition as defined by the surface condition's X coordinates, Y coordinates, and Z coordinates.

FIG. 3 shows another alternative embodiment of the system for evaluating a surface (10). As shown in FIG. 3, the system may comprising the first dispenser unit (500) and a second dispenser unit (600). The second dispenser may comprise a hardening agent vessel in fluid communication with a second nozzle array. The hardening agent vessel may contain the hardening agent and, in some embodiments, may further comprise a second mixing unit for maintaining the various components of the hardening agent at a more consistent temperature, viscosity, and blend. The hardening agent may be an acrylic polymer resin in a solvent carrier. In some embodiments, the hardening agent may include a filler material such as a fiber (glass or carbon) matrix which can improve the durability of the repair material. In some embodiments, the second dispenser unit may be partially or fully surrounded by skirting. In some embodiments, there may be one or more airflow ducts around the area of the second dispenser unit. Airflow duct(s) and skirting may be utilized individually or in combination with one another.

The second nozzle array may be of similar or identical construction to that of the first nozzle array. Specifically, the second nozzle array may be movably arranged in the system. The second nozzle array may also be in electronic communication with the detector unit (300) such that the detector unit communicates to the second nozzle array the specific plurality of X coordinates, plurality of Y coordinates, and plurality of Z coordinates corresponding to one or more surface condition to be repaired. The detector unit may then signal at least one nozzle of the second nozzle array to move in the X and Y plane to the X coordinate position(s) and Y coordinate position(s) corresponding to the surface condition(s) to be repaired, and simultaneously signal at least one nozzle of the second nozzle array to change from a nozzle closed to a nozzle opened position for a period of time sufficient to dispense a volume of repair material from the nozzle sufficient to fill the volume of the surface condition as defined by the surface condition's X coordinates, Y coordinates, and Z coordinates.

Figure 4:
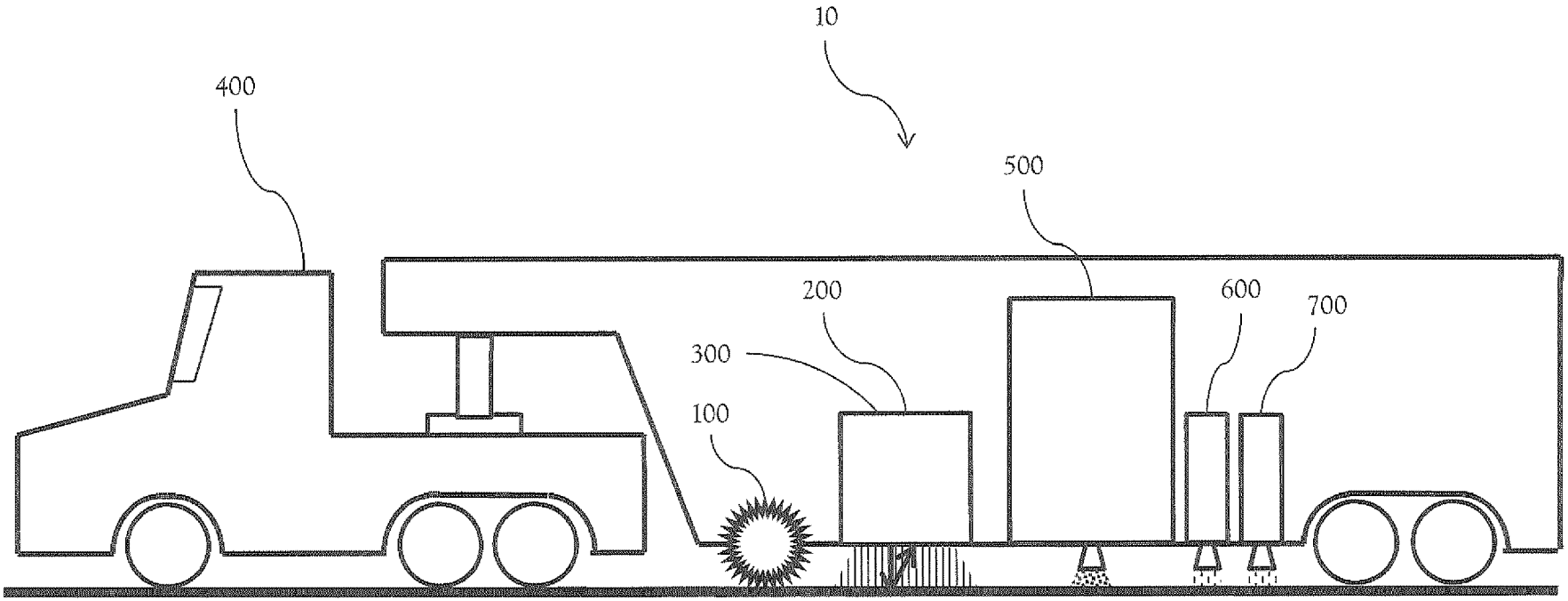
FIG. 4 depicts a side view of one embodiment of a system for evaluating and repairing a surface.

FIG. 4 shows another alternative embodiment of the system for evaluating a surface (10). As shown in FIG. 4, the system may comprise the first dispenser unit (500), the second dispenser unit (600), and a third dispenser unit (700). The third dispenser unit may comprise a coating vessel in fluid communication with a third nozzle array. The coating vessel may contain the coating and, in some embodiments, may further comprising a third mixing unit for maintaining the various components of the coating at a more consistent temperature, viscosity, and blend. Depending upon the application the coating may be selected from the group consisting of a wax sealant, a silicone sealant, bitumen, a mineral cover coating, an organic cover coating, and a fiber matrix material. In some embodiments, the third dispenser unit may be partially or fully surrounded by skirting. In some embodiments, there may be one or more airflow ducts around the area of the third dispenser unit. Airflow duct(s) and skirting may be utilized individually or in combination with one another.

The third nozzle array may be of similar or identical construction to that of the first nozzle array and/or the second nozzle array. Specifically, the third nozzle array may be movably arranged in the system. The third nozzle array may also be in electronic communication with the detector unit (300) such that the detector unit communicates to the third nozzle array the specific plurality of X coordinates, plurality of Y coordinates, and plurality of Z coordinates corresponding to one or more surface condition to be repaired. The detector unit may then signal at least one nozzle of the third nozzle array to move in the X and Y plane to the X coordinate position(s) and Y coordinate position(s) corresponding to the surface condition(s) to be repaired, and simultaneously signal at least one nozzle of the third nozzle array to change from a nozzle closed to a nozzle opened position for a period of time sufficient to dispense a volume of repair material from the nozzle sufficient to coat the surface condition with the coating material as defined by the surface condition's X coordinates, Y coordinates, and Z coordinates.

The method and system disclosed herein is useful for identifying surface and/or subsurface anomalies such as high moisture, voids, anomalous materials, and utility installations. Once identified, the system can "mark" specific surface and/or subsurface anomaly locations with a unique identifier, and record pertinent information. Such pertinent information may include, but is not limited to, latitude/longitude, visual image(s), type of anomaly, and possible repair actions.

What is claimed is:

1. A system for evaluating a surface and/or subsurface for a plurality of conditions comprising:

a surface contaminant removal device, an illumination device, a detector unit comprising at least one device selected from the group consisting of ground penetrating radar (GPR), lidar, ultrasound, and combinations thereof, a vehicle capable of travelling at a velocity of at least 1 mph, and a first dispenser unit comprising a repair material vessel in fluid communication with a first nozzle array, and wherein the first nozzle array comprises a number of rows of nozzles in the range of between 4 and 50 with a number of nozzles within each row in the range of between 50 and 500.

2. The system of claim 1, wherein each nozzle in a first nozzle row is offset along an x-axis relative to a preceding nozzle in a preceding nozzle row in a y-axis.

3. The system of claim 1, wherein the repair material vessel further comprises a first mixing unit.

4. The system of claim 1, wherein the first nozzle array is movably arranged in the system.

5. The system of claim 1, further comprising a second dispenser unit comprising a hardening agent vessel in fluid communication with a second nozzle array.

6. The system of claim 5, wherein the hardening agent vessel further comprises a second mixing unit.

7. The system of claim 5, wherein the second nozzle array is movably arranged in the system.

8. The system of claim 1, further comprising a third dispenser unit comprising a coating vessel in fluid communication with a third nozzle array.

9. The system of claim 8, wherein the coating vessel further comprises a third mixing unit.

10. The system of claim 8, wherein the third nozzle array is movably arranged in the system.

* * * * *